US005083584A

United States Patent [19]

Weidmann et al.

[11] Patent Number: 5,083,584

[45] Date of Patent: Jan. 28, 1992

[54] WEFT YARN DETECTOR FOR A SHUTTLELESS WEAVING LOOM

[75] Inventors: Erich Weidmann; Walter Schumperli, both of Wetzikon, Switzerland

[73] Assignee: Gebruder Loepfe AG., Kempten, Switzerland

[21] Appl. No.: 504,564

[22] Filed: Apr. 4, 1990

[30] Foreign Application Priority Data

Apr. 7, 1989 [CH] Switzerland ..... 1324/89

[51] Int. Cl.[5] ..... D03D 51/34

[52] U.S. Cl. ..... 139/370.2; 139/194

[58] Field of Search ..... 139/370.2, 194, 188 R

[56] References Cited

U.S. PATENT DOCUMENTS 3,536,105 10/1970 Picoll ..... 139/370.2
3,833,026 9/1974 Domig ..... 139/370.2
4,465,110 8/1984 Dekker ..... 139/370.2

FOREIGN PATENT DOCUMENTS 2429261 1/1977 Fed. Rep. of Germany .

*Primary Examiner*—Andrew M. Falik
*Attorney, Agent, or Firm*—Harness, Dickey & Pierce

[57] ABSTRACT

In order to monitor the correct receiving of an inserted weft yarn by a gripper in a receiving unit of a shuttleless weaving loom a detector is provided which is stationary mounted on the receiving side in an interspace between said gripper and a slay bar or reed of said weaving loom. Said detector comprises a plate-member projecting into said interspace or gap and having an inclined flank which is contacted by the weft yarn on his path between the inserting position and the beaten-up position. The passing of the weft yarn over this flank is detected by measuring potential variations in the detector during a defined phase of the machine cycle.

9 Claims, 2 Drawing Sheets

FIG. 3.
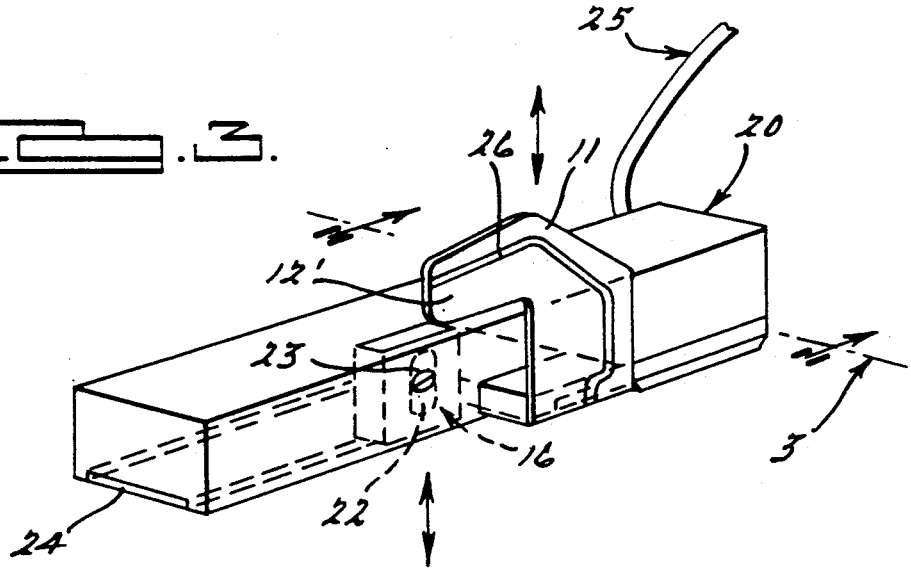
FIG. 4.
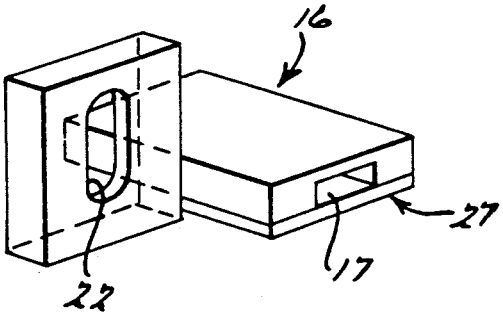
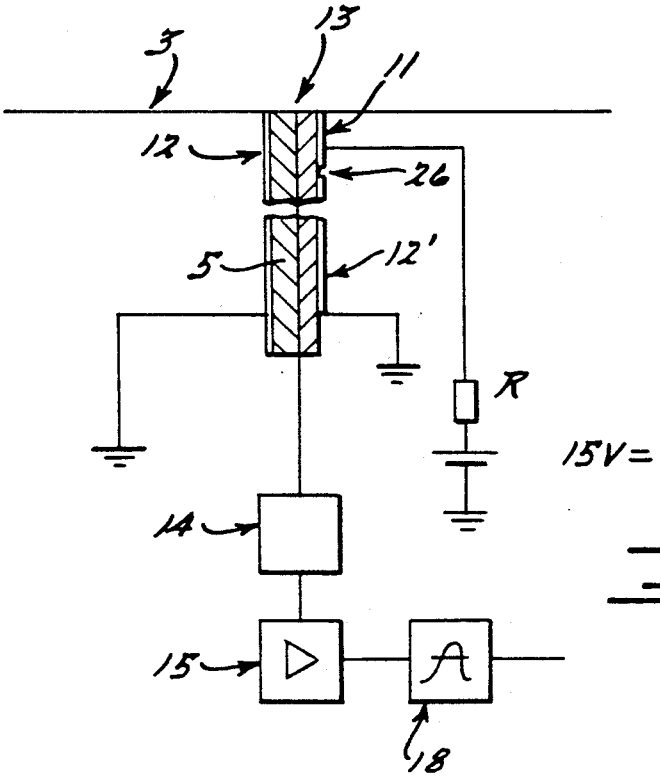
FIG. 5.

WEFT YARN DETECTOR FOR A SHUTTLELESS WEAVING LOOM

BACKGROUND OF THE INVENTION

1. FIELD OF THE INVENTION

The invention refers to a weft yarn detector in shuttleless weaving looms for detecting the presence or absence of the weft yarn in the shed after insertion of the weft yarn. It especially refers to weaving looms in which the weft yarn on the receiving side is clamped in a receiving gripper and moved together with this gripper towards the edge of the woven cloth in the beating up phase, wherein the correct position of the yarn in the receiving gripper is to be monitored.

2. DESCRIPTION OF THE PRIOR ART

An electromechanical sensor element is known from DE-Pat. No. 24 29 261, which for detecting the inserted weft yarn is integrated into a guide teeth mounted at the slay bar. This known sensor element is operated as follows: The inserted weft yarn is held and tensioned by said lateral receiving gripper while being beaten up. It is moved together with the receiving gripper towards the edge of the woven cloth. Simultaneously, the slay bar and the reed also are moved in the same direction. Thereby, the known sensor element is passed under the inserted weft yarn thereby contacting the same. However, since the sensor element and the weft yarn are moved substantially in the same direction there is an only small relative movement leading to small sensor signals, which are difficult to be discriminated from noise signals. Moreover, it can not be excluded that the sensor element also is contacted by warp threads. Unjustified machine stops or non detected faults may result therefrom. A further severe disadvantage of the known sensor is its location at the receiving side end of the slay bar. Since it replaces guide teeth, the guide characteristics for the projectile may be influenced near the receiving side of the slay bar. Moreover, this side of the slay bar is especially exposed to damage due to clamped projectiles and there is a danger of destruction of the expensive sensor. The electrical connection of the known sensor is complicated and expensive because it is arranged on a moving part of the weaving loom. Finally, one of the most important deficiencies of this sensor is its limited measuring range, since it can detect the presence or absence of the inserted weft yarn only in a very early phase of the beat-up motion. All faults happening in a later phase of the beat-up procedure are not detected.

SUMMARY OF THE INVENTION

Thence, it is a general object of the present invention to provide a weft yarn detector in a shuttleless weaving loom, which can easily be mounted without any change of functional elements of the loom.

A further object of the present invention is to provide a weft yarn detector by which the correct receipt of the inserted weft yarn by the receiving gripper and its correct clamped position therein can continuously be monitored until the weft yarn is beaten up.

Still a further object of the present invention is to provide a weft yarn detector generating a relatively strong detection signal which clearly can be discriminated from noise signals without however disturbing the correct function of the weaving loom.

Finally, it is an object of the invention to provide a weft yarn detector which can easily be mounted and adjusted to different kinds of yarn.

Now, in order to implement these and still other objects of the invention, which will become more readily apparent as the description proceeds, the weft yarn detector is manifested by the feature of comprising at least one detector element stationary mounted in a gap defined between the receiving end of the reed and the receiving gripper and positioned in the path of transverse displacement of the weft yarn between its insert position and its position at the edge of the woven cloth in order to detect the presence of the weft yarn at least over a part of said transverse displacement.

The positioning of the detector element in the small gap between the oscillating reed and the oscillating receiving gripper allows a stationary, fixed mounting of the detector at the weaving loom without need for any adaptation of functional elements of the weaving machine. The correct position of the weft yarn in the receiving gripper can be monitored during about the half way of the inserted weft yarn from its initial to its beaten-up position which allows to detect all possible faults in this late stage of the weaving cycle.

Preferably, the detector element has an inclined surface or flank, intersecting the transverse path of the inserted weft yarn to its beaten-up position, so that the inserted yarn is passed over this surface. Thereby the stationary detector is self-cleaning and its function is not affected by dust depositions. Since the generated detector signal depends of the movement of the yarn over said inclined surface, the detector signals increase with increasing machine speed and therefor can easily be discriminated from noise signals even at high speed. Due to the stationary mounting of the detector, all electrical connections from the detector to an impedance transformer can easily be shielded which considerably reduces the noise level.

BRIEF DESCRIPTION OF THE DRAWINGS

The invention will be better understood and objects other than those set forth above will become apparent when consideration is given to the following detailed description thereof. Such description makes reference to the annexed drawings, wherein:

FIG. 3 is a perspective view of the weft yarn detector exhibiting the housing and the detection plate of the detector;

FIG. 4 is a perspective view of the supporting element for the detection plate, and FIG. 5 a schematic sectional view of the detection plate combined with a block diagram of the detection circuit.

DESCRIPTION OF A PREFERRED EMBODIMENT OF THE INVENTION

Figure 1:
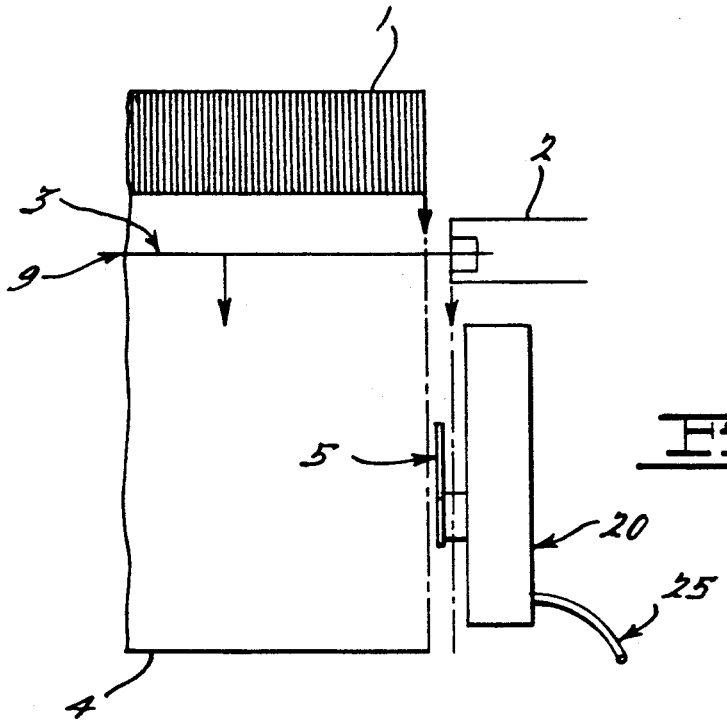
FIG. 1 is a schematic plan view on the receiving side of a shuttleless weaving machine for the illustration of the position of the detector.

The herein described embodiment refers to a known projectile weaving loom, wherein the weft yarn is transported through the shed by means of a projectile which is driven to move from a yarn picking unit on one side of the loom to a yarn receiving unit on the other side of the loom. The projectile is guided on its way from the picking to the receiving unit by guide teeth arranged at a slay bar or reed 1. At the receiving side the weft yarn 3 is taken over by a gripper 2 at the receiving unit and held therein in a tensioned state during the beat-up procedure. As indicated in FIG. 1 the gripper 2 and the reed 1 are moved towards the edge 4 of the woven cloth when beating-up the weft yarn. As also can be seen, there is a small gap of about 3 mm between the path of the reed 1 and the path of the gripper 2 on their way towards the edge 4 of the woven cloth. The invention refers to known machines of this type, as e.g. the projectile weaving loom of SULZER-RUETI AG, Switzerland.

Figure 2:
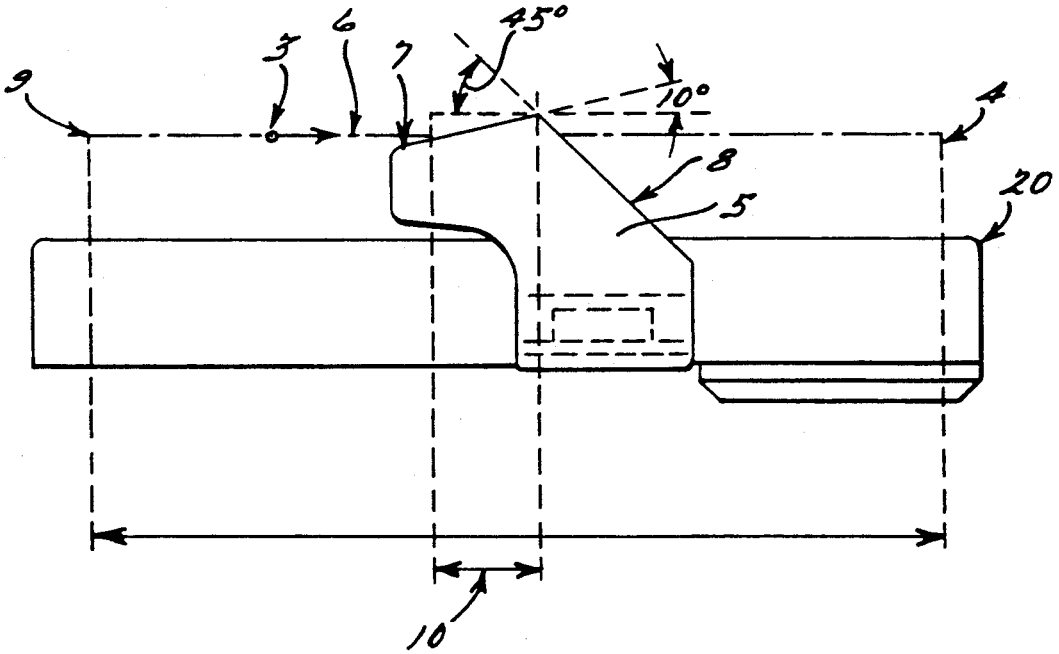
FIG. 2 is an enlarged side view of the weft yarn detector, the path of the weft yarn being indicated by a dotted line.

According to the invention the detector comprises a housing 20 for an electronic circuit to be described later on and a detector plate 5 mounted to said housing. The housing 20 is located below the path, of the gripper 2 as can be seen from FIG. 1 , whereas the detector plate 5 projects from below into said gap and into the transverse path of the inserted weft yarn between its initial and its beaten-up position. In FIG. 2 this path 6 of the weft yarn 3 and the position of the detector plate 5 relative thereto is exhibited in enlarged side view.

As can be seen from this figure the detector plate 5 has at its upper end a flank 7 inclined relative to the path 6 of the weft yarn 3 and intersecting the same in an angle of about 10°. On its path to the edge of the woven cloth, the inserted and tensioned weft yarn is passed over said flank 7 and is released again at the rear flank 8 of the detector plate 5. The corresponding detector zone 10 is about in the middle between the position of insertion 9 the weft yarn and its beaten-up position 4, as can be seen from FIG. 2. In the machine cycle of a total of 360°, this corresponds to a machine angle between 25° and 35°. Therefore, the correct presence of the weft yarn can be monitored when said machine angle is reached immediately before beat-up.

If the weft yarn 3 is correctly clamped in the gripper 2 of the receiving unit, an electrical signal is generated by the movement of the tensioned yarn 3 over said flank 7 of the detector plate 5. If this signal is detected at said machine angle, the yarn 3 has correctly been received. If on the other hand, no signal is detected in this phase of the machine cycle, this means that no weft yarn is present because e.g. it has not correctly been gripped by the gripper 2 after insertion. In this case, an alarm signal is generated in electric circuit to be described, which may cause a machine stop.

The construction of the detector and especially of the detector plate 5 can best be seen from FIG. 5, exhibiting an enlarged schematic sectional view of the detector plate 5 and a block diagram of the circuit connected thereto. The detector plate 5 has a thickness of only about 1 mm and has a laminated or layered structure. In the upper zone of the plate 5 three conducting layers 11, 12, 13 are arranged adjacently. One of the two outer conducting layers, i.e. layer 11, is connected to a voltage source of 15 V-DC through a resistor R of 2.2 k Ohm. The other outer conducting layer 12 is connected to earth potential. The same is the case for a lower portion of layer 11, which is separated from layer 11 by an isolating gap 26 and is designated with the reference numeral 12' (see FIG. 3).

The conductive layer 13 in the center of the detector plate is the detector layer and is connected via an impedance transformer 14 to an amplifier 15 and a threshold value discrimination unit 18. The operation of this structure substantially corresponds to what is described in Swiss patent specification No. 479478. From the layer 11 connected to a voltage source the weft yarn 3 is provided with static electric charges, when the weft yarn 3 contacts this layer 11 at the flank 7 of the detector plate 5. The static charges on the weft yarn generate potential variations in the central layer 13. These potential variations are transformed into an electric signal by means of the impedance transformer 14 (10 M Ohm to 10 Ohm) and the amplifier 15. If the electric signal from the amplifier 15 exceeds a threshold value which is substantially above the noise signals, the correct presence of the weft yarn can be assumed, else a fault signal is generated by the threshold value discrimination unit.

One of the major difficulties is the low signal amplitude (potential variations) generated by the weft yarn when passing over the detector plate. Therefore it is important to electrically shield the detector layer 13 and its connection to the impedance transformer to suppress the generation of noise signals. To this end the outer surfaces of the detector plate 5 are covered with conductive layers 12,12'. Furthermore the detector plate 5 is mounted to a support element 16 (see FIGS. 3 and 4), which is of conductive material (metal) and has an opening 17 for receiving the impedance transformer 14. The opening 17 has a bottom wall 27, which at its outer surface is covered with a copper layer. The electric connection from the detector layer 13 at the flank 7 of the detector plate 5 to the impedance transformer 14 therefore is a short as possible and is electrically shielded, which allows to substantially reduce the noise signals.

In order to make sure that at different conditions (depending on the weft yarn quality or the cloth to be woven) a good detection of the weft yarn 3 is possible, the detection plate 5 can be adjusted in its vertical position relative to the path of the weft yarn 3. The support element 16 comprises a portion having an oblong perforation 22 and is fixed to the housing 20 by means of a screw 23 extending through said perforation 22 and accessible from the outside. As shown in FIG. 3 by means of arrows, the detection plate 5 can be adjusted in its vertical position relative to the housing 20 of the detector. The detector plate 5 thereby is adjusted to a height at which the flank 7 intersects the path of the weft yarn so that it passes over the flank 7 under slightly increasing tension to generate a detector signal.

The housing 20 of the weft yarn detector is fixedly mounted to a stationary part of the weaving loom below the gripper 2 of the receiving unit. It contains the above mentioned circuit elements, i.e. the impedance transformer (in the support element 16), the amplifier and the threshold value discriminator. It also has a bottom wall covered with a copper layer at its outside for shielding said elements. From the housing 20 a connector cable 25 is guided to a respective display- and evaluation unit which is of substantially known type.

The herein described detector is based on the principle of detecting potential variations generated by the movement of the yarn relative to a surface. It is advantageous because it is not critical to vibrations or shocks of the machine since the detection is not based on measuring forces or the like. It also is not critical to dust from the weaving process. The flank 7 of the detector is cleaned by the weft yarn itself which under a certain tension passes over said flank.

However, it is also possible to use other types of detectors at said detector plate 5. Especially, a stationary piezoelectric element can be placed instead at said detector plate, which when contracted by the weft yarn on its transverse path generates a detector signal. It also would be possible to use an stationary optical detection at this location to detect said transverse movement of the weft yarn between its inserted position and its beaten-up position.

As already mentioned the above described detector is especially suited for projectile weaving looms of the type SULZER-RUETI or similar shuttleless weaving looms, since no functional parts of such machines have to be changed for mounting this detector. Accordingly, the detector can easily be mounted to already installed or older machines. In addition to the above advantages the detector of the invention allows the detection of the weft yarn at a precisely defined moment in the machine cycle, i.e. between the machine angles 25° to 35° immediately before the weft yarn is beaten-up. Therefore, possible faults can be detected until the very end of each weaving cycle, which makes sure that no fault, even if it occurs in a late phase, remains undetected.

While there is shown and described a preferred embodiment of the invention, it is to be distinctly understood that the invention is not limited thereto, but may be otherwise variously embodied and practiced within the scope of the following claims.

What is claimed is:

1. A weft yarn detector in combination with a shuttleless weaving loom, said weaving loom having means for inserting a weft yarn from a picking side through a open shed to a receiving side, a receiving unit at the receiving side with a gripper for holding the inserted weft yarn and a slay bar or reed for beating-up the inserted weft yarn towards an edge of a woven cloth, said gripper and said slay bar or reed being mounted to be moved towards said edge of the woven cloth during said beating-up process thereby displacing said inserted weft yarn along a defined path towards said edge of the woven cloth, said gripper and reed leaving between them an free space, wherein said weft yarn detector comprises a housing mounted to a stationary part of said weaving loom and a stationary detecting element projecting into said free space and intersecting said defined path of said weft yarn to detect said displacement of said weft yarn at least along a part of said defined path.

2. The weft yarn detector of claim 1, wherein said stationary detecting element has an inclined flank intersecting said path of the inserted weft yarn, over which flank said weft yarn is passed during its displacement.

3. The weft yarn detector of claim 1, wherein said stationary detecting element has a plate member projecting in vertical position into said gap and having an upper edge forming said inclined flank.

4. The weft yarn detector of claim 3, wherein said plate member comprises three parallel, conductive layers ending at said flank and isolated from each other, an outer one of these three layers being connected to a voltage source and a central one of these layers being connected to a measuring circuit for evaluating a signal generated by said weft yarn contacting said layers at said flank.

5. The weft yarn detector of claim 4, wherein said three conductive layers extend parallel to a plane defined by said plate-member, said central layer extending substantially in the middle of said plate-member.

6. The weft yarn detector of claim 4, wherein said central layer is connected by electric connector to an impedance transformer, said central layer being shielded.

7. The weft yarn detector of claim 6, wherein said plate member is supported by a support member having conductive walls and comprising said impedance transformer.

8. The weft yarn detector of claim 2, wherein said inclined flank defines a detector zone along said path of said inserted weft yarn, which zone is located substantially midway of said path between an insertion position of said weft yarn and a beaten-up position at the edge of the woven cloth.

9. The weft yarn detector of claim 1, wherein said stationary detecting element being vertically adjustable relative to said housing of the detector.

* * * * *